United States Patent [19]

Bartenfeld et al.

[11] 4,015,550

[45] Apr. 5, 1977

[54] APPARATUS AND METHOD FOR SELECTIVE MULTI-COLOR DYEING OF INDIVIDUAL YARNS AND PRODUCING THEREFROM A PREDETERMINED COMPLEX DESIGN IN A TUFTED CARPET

[75] Inventors: William Chelsea Bartenfeld; Clifford Aldene Bryant; Wilbur Koontz Newman, Sr., all of Dalton, Ga.

[73] Assignee: West Point Pepperell, Inc., West Point, Ga.

[22] Filed: Aug. 12, 1975

[21] Appl. No.: 603,930

[52] U.S. Cl. ..... 112/79 A; 28/75 R

[51] Int. Cl.[2] ..... D05C 15/26

[58] Field of Search ..... 112/79 A, 79 R, 79.5, 112/218 R, 80; 28/75 R, 77; 68/203

[56] References Cited

UNITED STATES PATENTS

| | | | |
|---|---|---|---|
| 1,990,907 | 2/1935 | Kellogg | 112/218 R |
| 3,623,440 | 11/1971 | Spedding et al. | 112/79 A |
| 3,692,466 | 9/1972 | Mercer | 28/75 R |

*Primary Examiner*—H. Hampton Hunter
*Attorney, Agent, or Firm*—Davis, Hoxie, Faithfull & Hapgood

[57] ABSTRACT

The apparatus and the method of the invention dyes the yarn ends of a sheet thereof individually at predetermined positions along their lengths and manufactures tufted carpets therefrom in a tufting machine to provide a predetermined multi-colored complex pattern in the carpet. The invention includes pretreatment of the yarn in a wetting and cleansing bath, removing excess bath liquid in preparation for dyeing, synchronizing the yarn feed at the start with the feed to the tufting machine, simultaneous dyeing of pairs of adjacent yarn ends and separating them for delivery to the tufting machine in an arrangement to produce identical patterns side-by-side in the carpet.

34 Claims, 9 Drawing Figures

FIG. 3
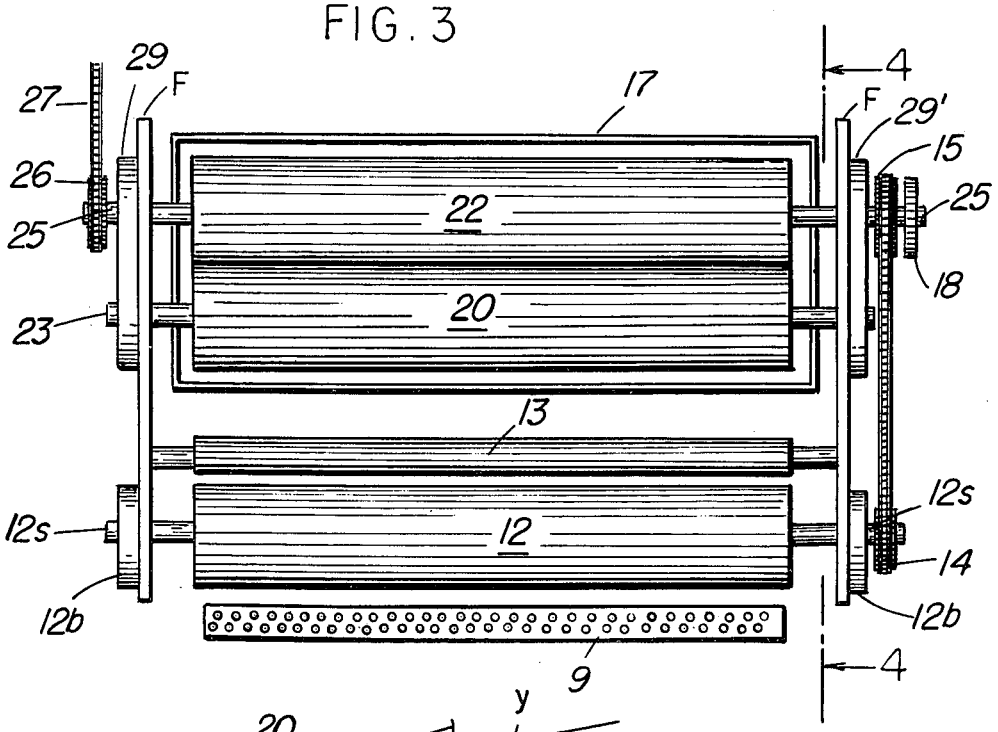
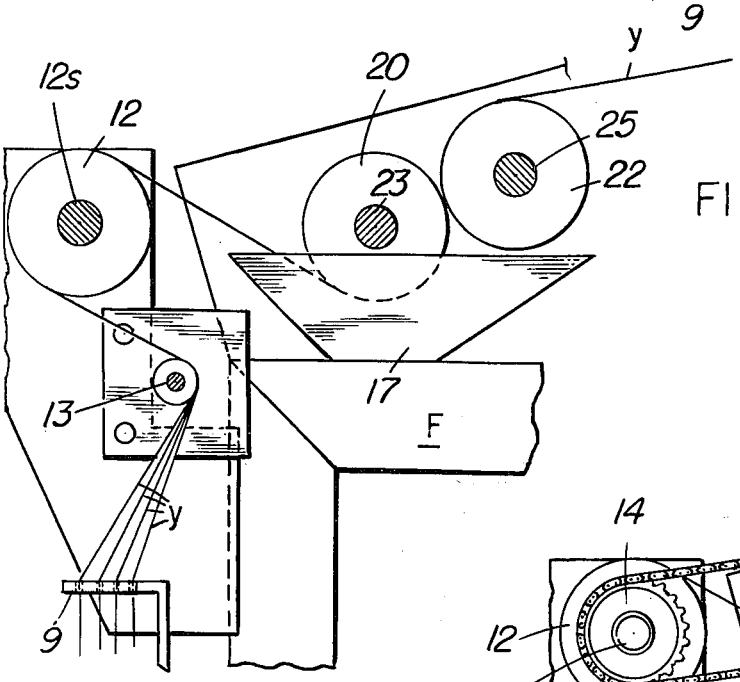
FIG. 4
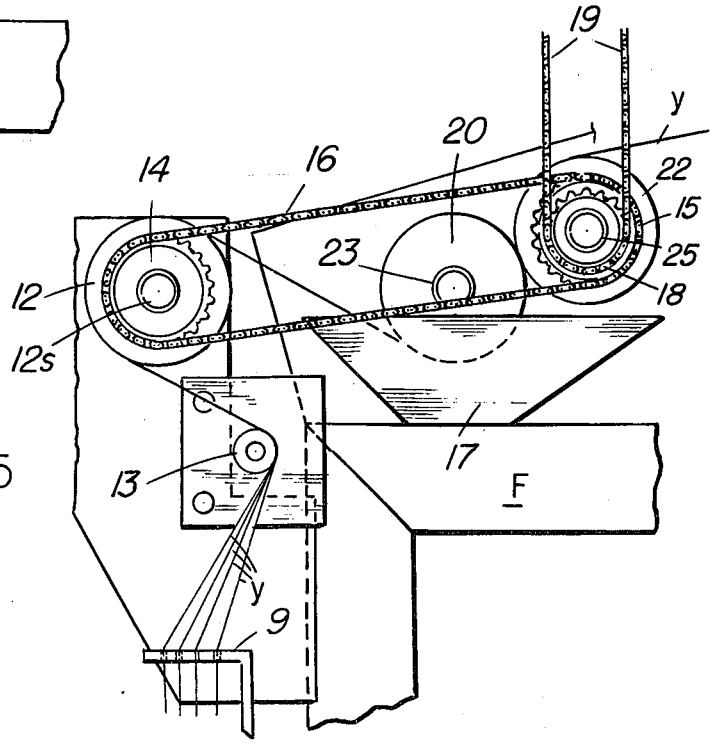
FIG. 5

FIG. 6
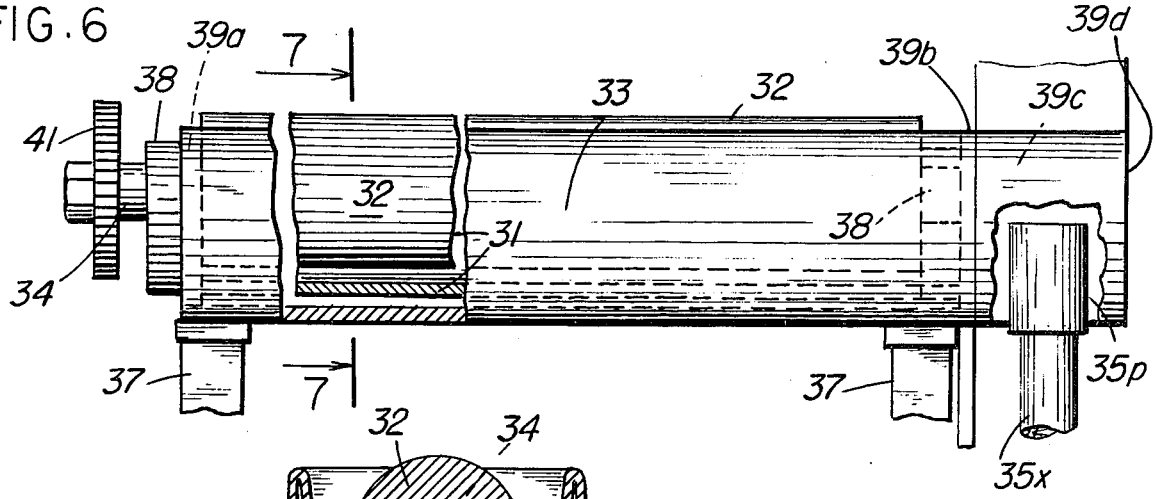
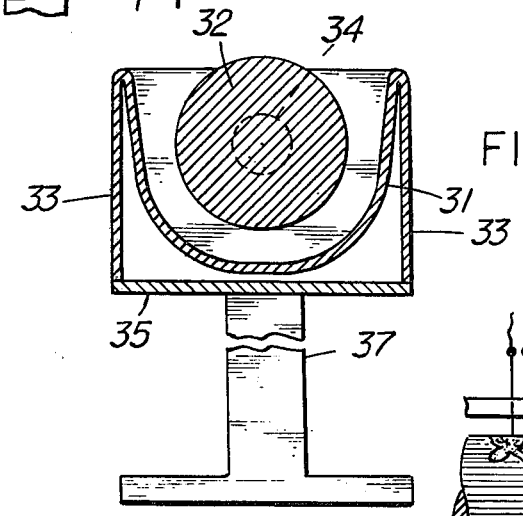
FIG. 7
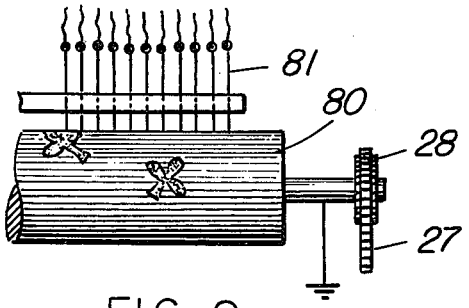
FIG. 9
FIG. 8
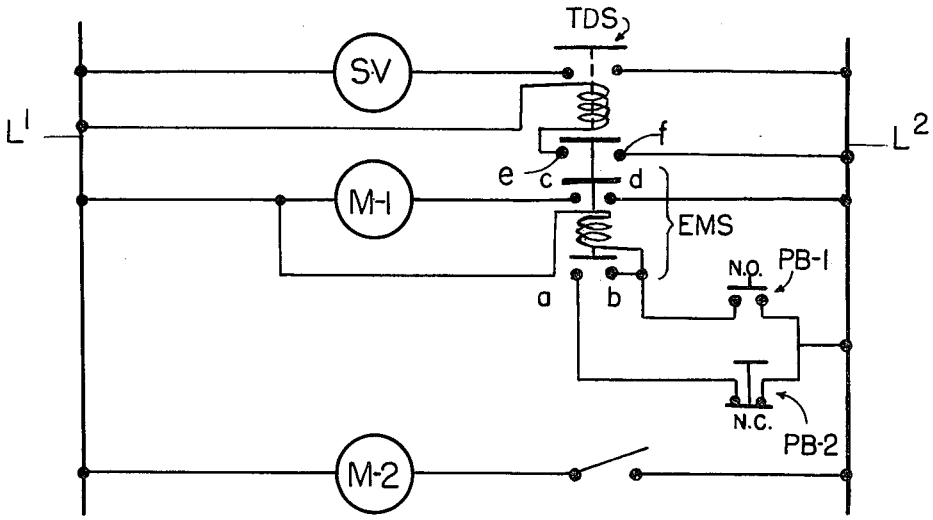

APPARATUS AND METHOD FOR SELECTIVE MULTI-COLOR DYEING OF INDIVIDUAL YARNS AND PRODUCING THEREFROM A PREDETERMINED COMPLEX DESIGN IN A TUFTED CARPET

This invention relates to a method and apparatus for selective multi-color dyeing of individual yarns and producing therefrom a predetermined complex design in a tufted carpet, which can be repeated in continuous production. The invention particularly relates to carpets made by machines commonly called tufting machines in which yarns fed to individual needles of a continuously reciprocating bank of needles are pushed through a backing sheet to form tufts, stitches or loops that may be cut or remain as uncut pile in the finished carpet.

PRIOR ART

Heretofore many variations of tufting machines have been developed which are capable of producing cut or uncut pile of uniform or different heights — high, low or intermediate — and a large variety of combinations of the same. An almost infinite variety of designs have been produced using one or more or all of said varieties of pile producing a sculptured effect and/or including color variations.

When using differently colored yarns which have been pre-dyed in bulk, practical considerations limit production of many desirable designs even though a myriad of multi-colored designs have been made.

When producing floral, modernistic, oriental or other complex designs different colors have been sprayed on the pile of completed carpets, or have been printed in various ways thereon, to produce the desired design. However, problems have arisen in applying the dyes to finished pile, due to inability to penetrate the pile and to apply the dyes evenly and completely and only in the areas (sometimes very small) where the dye should be and remain.

It has been proposed to apply different colored dyes to the individual yarns at spaced predetermined positions along their lengths, determined with reference to a pattern or design that is ultimately to appear in the finished carpet. However, for various reasons, these proposals have been impractical or have not been commercially successful.

SUMMARY OF THE INVENTION

According to the present invention a machine and method are provided in which the yarns are prepared to be dyed, and are then dyed individually at different places along their length with different colors; and they are prepared for delivery to a tufting machine and are fabricated into a carpet bearing a predetermined complex design. All this is done without interruption and without variation of the relationship of the yarns, one to another. More specifically, the individual yarns are conditioned for dyeing by being led from a supply in the form of a sheet to a bath containing cleansing and wetting materials, after which the yarns are squeezed between pressure rollers to remove most of the liquid. Then the yarns are directly passed individually over a series of dye pick-up rolls. In the course of this passage, the yarns are lowered into contact with one or more or all of the pick-up rolls for predetermined limited times to cause predetermined variable lengths of the individual yarns to be individually dyed. The colors and lengths of the dyeing are determined by the desired pattern that is to appear as the dyed segments of yarn become loops, tufts or stitches in the carpet fabric.

After dyeing, the sheet of yarns may immediately enter a steam chamber wherein the dye is fixed in the yarn or the dye setting may be omitted at this stage and the sheet may immediately enter a drying chamber from which the yarns are individually fed through identical length guide tubes directly to the conventional tufting machine, whose feed rolls are synchronized with and have the same peripheral speed as the rolls that fed the yarn sheet to the dyeing portion of the apparatus.

Throughout, the positions of the individual dyed yarns relative to one another are maintained so that as they enter the tufting machine they will have the same relationship as when the dyes were applied. Thus, in the carpet fabric the colored tufts will appear in a relationship or pattern which was predetermined before the dyes were applied.

Time delay means are provided to delay disengagement of the yarns from the dye-pick-up rolls and to cause this to occur simultaneously with complete cessation of the movement of the tufting machine to compensate for momentum of the tufting machinery when the power to it is shut off vis-a-vis the instantaneous lifting of the yarn from the pick-up rolls.

Provision is also made for easy and quick removal of the dye-pick-up rolls and their troughs for cleaning, replacement or repair.

The several objects and advantages of the invention will become apparent as it is described in connection with the drawings.

DESCRIPTION OF THE INVENTION

In the drawings,

FIG. 3 is a plan view of the end of the apparatus of FIG. 1 where a sheet of yarns enters and is subjected to treatment before dyeing.

FIG. 4 is a side elevational sectional view taken along line 4—4 of FIG. 3 showing the yarn passage through the position of the apparatus shown in FIG. 3.

FIG. 5 is a side elevational view of the end of the apparatus of FIG. 1 showing the driving mechanism for the draw and squeeze rolls.

FIG. 6 is an elevational view partly broken away and partly in section of a dye-pick-up roll and its trough removed from the dyeing machine.

FIG. 7 is a sectional view taken along line 7—7 of FIG. 6.

FIG. 8 is a circuit diagram of the control of the motors and switches which operate the apparatus.

FIG. 9 is a fragmentary side elevational view showing diagrammatically one of the pattern drums.

Figure 1:
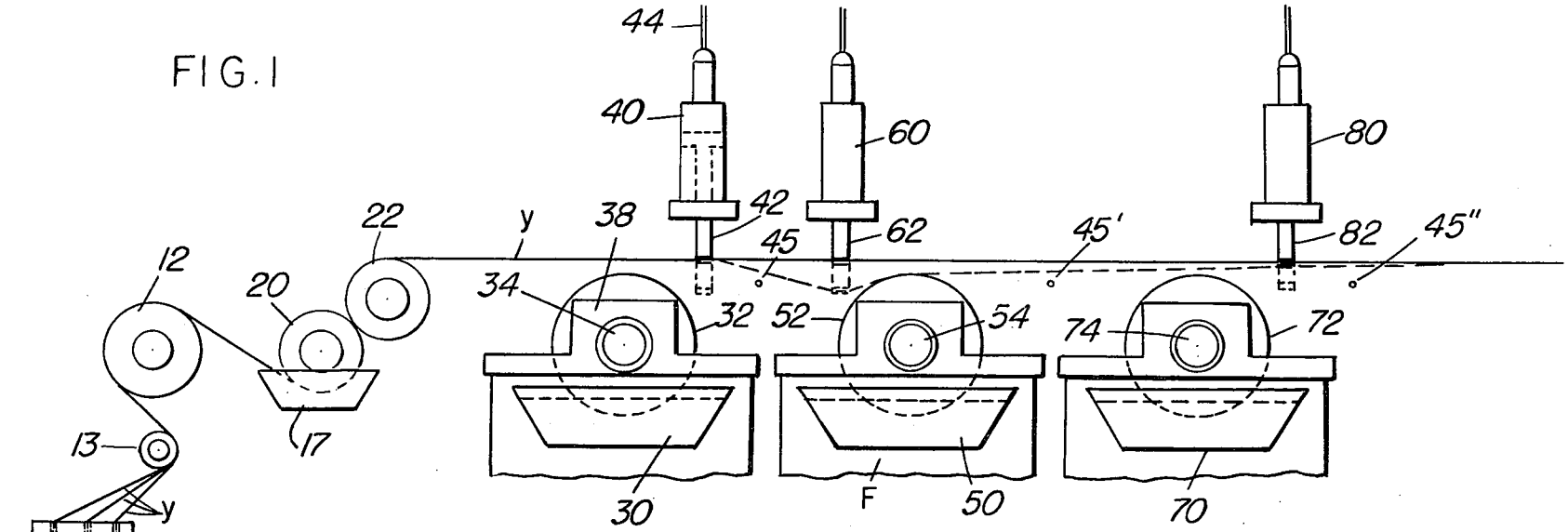
FIGS. 1 and 2 are elevational views showing diagrammatically the method and apparatus embodying the invention, FIG. 2 being a continuation of FIG. 1.

Referring to the drawings, the yarns Y from a creel or spools, are spread into the form of a sheet, are threaded up through a horizontal yarn guide plate 9 having several rows of staggered holes, from which the yarns pass around a horizontal idler roll 13 and around and over a parallel draw roll 12 mounted on a horizontal shaft **12*s* supported in bearing 12*b* in the machine frame F above the idler roll 13**. The draw roll has a rough surface and is power driven and pulls the yarns from the supply.

The machine frame F may be of any suitable form and number of parts to support the various elements of the machine as described herein.

PRE-TREATMENT OF THE YARN ENDS

In order to prepare and condition the yarns so that they will pick-up and retain dyes, later to be applied at spaced places along the length of the yarns, a bath is provided in a trough or like receptacle 17.

The bath in the receptacle or trough 17 preferably contains common wetting, cleansing, and anti-foaming agents. The precise composition and character of the wetting, cleansing, and anti-foaming agents is selected and determined in accordance with the composition of the particular fibers of the yarn and the dyes used. The composition of these agents per se is not a part of this invention. These agents are available on the market from various suppliers, and they are sold under a number of trade names. It is important, however, that the yarns be treated at this stage in the process in order that dye which is applied in the immediately-following dyeing stage of the process is absorbed and penetrates the fibers of the yarns in the short time that the yarns are subjected to the dyes. Even though wetting and anti-foaming agents may also be present in the dye bath to facilitate adherence of the dyes on the hereinafter described dye-pick-up rolls, it is important to pretreat the yarn ends so that they will be in optimum condition to accept the dye.

The yarn sheet passes from the draw roll 12 into the bath under the first (20) of a pair of parallel horizontal squeeze rolls 20, 22 which are mounted on shafts 23, 25 journalled in bearings in bearing blocks 29, 29' supported from the machine frame at each end of the rolls. The passage of the yarns between the squeeze rolls leaves the yarns with about 80% moisture content. That is to say if 100 represents the weight of the dry yarn, its weight on leaving the squeeze rolls would be 180. From these rolls, the yarns go directly to dyeing apparatus which in the example illustrated is provided with means to apply four colors in succession at spaced points along each individual yarn end, or pair or small group of yarn ends.

THE DYEING APPARATUS

In order to apply dye at spaced positions along the yarns, four (or more or less) identical stainless steel dye-pick-up rolls 32, 52, 72, 92 are provided, mounted on shafts 34, 54, 74, 94, and positioned over troughs 30, 50, 70 and 90, containing dyes of different colors and additive chemicals to assist adherence of the dyes to the pick-up rolls, to penetrate the yarn, to fix the dye to the fibers and to reduce foam. The lower part of each roll is immersed in the bath and picks up dye as the roll turns. The shaft 34 of roll 32 is journalled in bearings in bearing blocks 38. The trough 30, bearings and roll 32 are supported in such a way as to be removable as a unit sidewise from the machine as will presently be described. The rolls 52, 72, 92 are similarly supported and positioned with respect to their dye troughs and are removable.

Above each pick-up roll is mounted a bank of yarn-end-manipulating assemblies located in one, two or more parallel rows extending parallel to the rolls. For example, in a typical 36 inch width machine, there were 48 assemblies in each of two rows, with the assemblies in the second row staggered or offset from the first row, by reason of space limitation requirements. Thus, there were a total of 96 assemblies across the 36 inches of width of the machine. In the typical machine being described, two "repeats" were provided. This was done by having a pair of yarn ends under control of each piston rod of each of the hereinafter described yarn manipulating assemblies, thus providing a total of 192 yarns to be fed to the tufting machine.

Each yarn-manipulating assembly comprises a vertically mounted pneumatic cylinder such as 40 containing a plunger with a stem or piston rod such as 42 extending out the lower end in a position offset from directly-vertical position over the roll. The plunger and roll are normally biased upwardly by a coiled compressing spring within the cylinder 40. A conventional electromagnetically operated solenoid valve (not shown) controls inlet and exhaust of air to and from the cylinder through a connection such as 44 to an air supply.

The details of the pneumatic assemblies and solenoid valves need not be described since they are known pieces of equipment having been available on the market and used for various purposes in various machines (see Hackney et al. U.S. Pat. No. 2,954,865).

The individual yarn ends (or pair of ends in the example being described) pass through openings at the lower end of the downwardly extending portions of the piston rods. These openings are preferably apertures with straight horizontal bottom edges and generally of rectangular shape. Alternatively the openings may have open bottoms. Each of the assemblies is placed so that when its piston and rod are down, the yarn end or ends it carries will be pushed down into contact with the adjacent pick-up roll. More specifically, the first assembly controls the position of the yarn Y between the squeeze roll 22 and itself. In the inactivated position the rod 42 is up, in the position shown in FIG. 1, and the yarn is out of contact with the pick-up roll 32. When activated, the rod 42 moves down carrying the yarn into contact with the pick-up roll 32.

In corresponding fashion when the rod 62 of the second assembly is inactivated (up, as shown in FIG. 1), the yarn is held from contacting the roll 52, whether or not the first assembly is activated. But when the second assembly is activated, the rod 62 moves down and carries the yarn into contact with pick-up roll 52 as shown in dashed lines in FIG. 1.

And, likewise, when rod 82 of the third assembly is up, the yarn is held from contacting the third pick-up roll 72, whether or not the rod 62 of the second assembly is activated.

Figure 2:
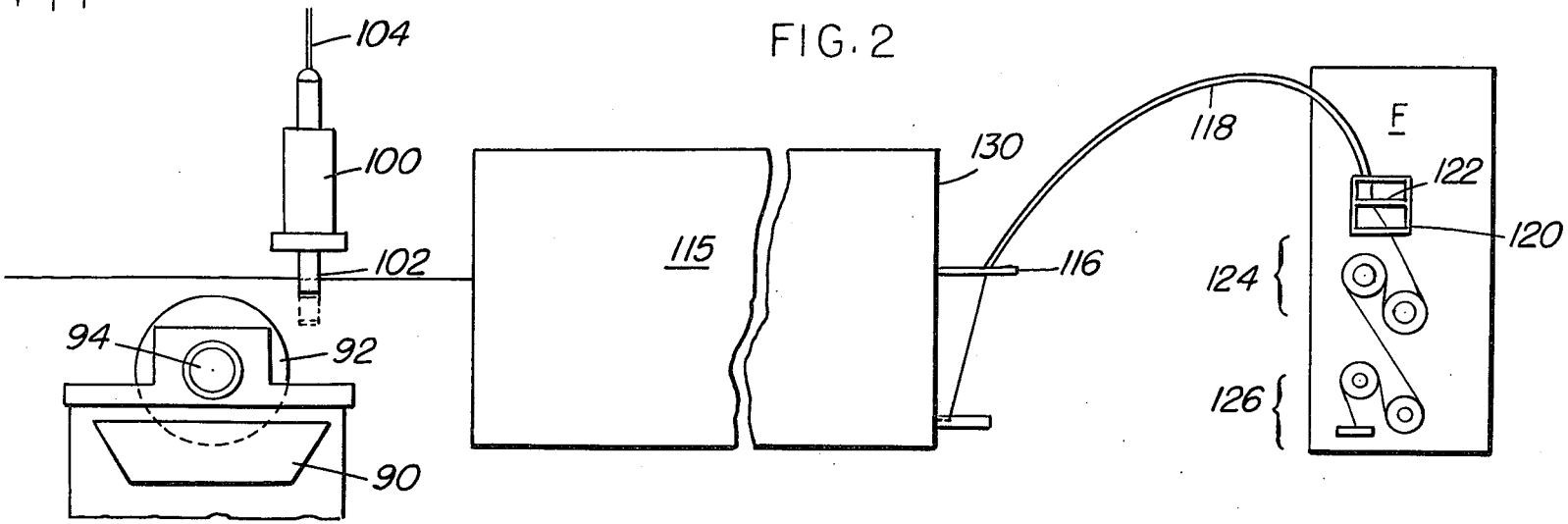

From the explanation given, it will be understood how activation of the fourth assembly will cause the yarn to contact the fourth pick-up roll (as shown in FIG. 2), or to be freed to move up from such contact upon deactivation.

Since the yarn is constantly moving forward through the machine, the yarn end will be dyed with different colors along its length. The places where a particular color is applied will depend upon when the particular dye assembly is activated. The length of the stretch or segment that is dyed will depend on how long the activation continues and how fast the yarn sheet is moving.

The variety of color sequences is infinite along any yarn end or ends carried and controlled by the four longitudinally positioned assemblies (which may be more or less in any particular machine) and so also are the lengths of individual dyed stretches, therealong. Moreover, the variety of colorings of yarns transversely across the sheet is infinite since the adjacent yarn ends which are carried by individual transversely adjacent assemblies can be dyed entirely independently of each other.

In order to provide a support for a sagging yarn or a broken yarn, a thin wire 45 such as a piano wire is tautly stretched horizontally and transversely across the machine about midway between the dye-pick-up rolls 32 and 52. The wire is located slightly, e.g., approximately ¼ inch, below the plane of the tops of rolls 32 and 52 and is secured to the sides of the machine frame. Similarly, wires 45' and 45'' are located between rolls 52 and 72 and 72 and 92.

Control of the solenoid valves which activate the pneumatic yarn-manipulating assemblies may be by a power driven rotating pattern drum 80 with conductive fingers 81 rubbing over conductive and non-conductive portions of a pattern laid out on the surface of the drum. See FIG. 9.

Alternatively, other pattern controls may be employed, of which the digital pattern control as disclosed in the Strother et al U.S. Pat. No. 3,722,434 assigned to the assignee of this application is only one example.

PATTERN CONTROL

A pattern is prepared and laid out on a drum such as 80 in FIG. 9 for controlling the movement of each individual yarn as it passes over the first dye-pick-up roll 32; and likewise, separate drums are provided and separate patterns are prepared to be put on each drum for each of the other dye-pick-up rolls 52, 72 and 92. All drums are alike and all rotate at the same speed.

There is a need for separate pattern drums and patterns for controlling the yarn movement in connection with each assembly because of complications arising when an attempt is made to use only one drum and pattern having conductive and non-conductive areas and switch fingers for all four solenoid valves for all of the yarn ends in the yarn sheet. Even in small 36 inch width machines, there are space problems and overlapping control lines due to the hundreds of elements involved. Similar problems arise when the pattern control consists of light and dark areas with light conductive plastic rods with associated light responsive electric switching devices, sometimes known as electric-eyes, are used.

Due to the longitudinal spacing along the length of the machine of the yarn control assemblies and dye rolls, the zero or starting point of the patterns as laid out on the pattern drums is different on each drum. In other words, the controlling action of the drums must be coordinated; and the start of the patterns on the second, third and fourth drums must follow the start of the first drum by the amount of time taken for the yarn to travel from the first drum to the second, third or fourth drum. Having determined the starting point, the pattern layout may be determined for each drum.

DYE ROLL AND TROUGH REMOVAL

Because the apparatus runs for considerable periods of time and is subject to wear and because the dye baths and dye-pick-up rolls must be maintained in clean and unimpaired operating condition, it is desirable to be able to clean, repair or replace the dye-applicator rolls and troughs quickly and easily. For that purpose, each trough and its dye applicator roll is assembled as a unit and fabricated so that the unit can be removed separately from the machine with great ease and facility without the other dye units being affected. Since all the units are mounted in the same manner, a description of the first unit will suffice.

Roll 32 is made of stainless steel and is located in the metal trough 30. The trough is or may be of a stainless steel sheet bent into U-shape as at 31 with folded over portions forming parallel side walls 33 which extend downwardly and are welded or otherwise secured along its bottom edges to a flat horizontal bottom plate 35 (see FIG. 7). The plate 35 is mounted at each end on inverted T-shaped pedestals 37 which rest on the floor.

The ends of the U-portion 31 of the trough are closed by flat vertical plates **39*a*, 39*d* which are welded or otherwise secured to the trough. To support the roll 32 bearing blocks 38 are mounted on the end plates 39*a*, and on an intermediate wall 39*b* which support bearings for the ends of the shaft 34.**

One end of the shaft extends outwardly in the direction in which the unit is to be removed from the machine and has a drive gear 41 mounted thereon by which the roll 32 is rotated when the unit is in place in the machine. At the other end of the trough, the intermediate wall **39*b* and end wall 39*d* form a compartment 39*c*. The intermediate wall 39*b* does not extend all the way to the bottom of the trough, thus providing a passage for flow of the dye between the compartment 39*c* and the central part of the trough. A removable open-ended overflow stand pipe 35*p* is positioned over a machined orifice and outlet pipe 35*x* in the bottom of the compartment 39*c*** making a tight joint. Upon lifting of the stand pipe, the dye of the trough may be drained. But while the stand pipe is standing in place, the level of dye in the trough is maintained at not more than the height of the stand pipe. Dye may be continuously fed into the trough and circulated in any suitable conventional fashion.

Although the trough and roll unit above described is horizontally removable, it will be understood that the units could be individually vertically removable.

After the final dye assembly has been passed by, the yarn sheet goes into a conventional drying chamber 115 wherein the yarns are thoroughly dried.

As an alternative, instead of deferring setting of the dye, the yarn may be carried on into a conventional steam chamber (not shown) between the dyeing stage and the drying chamber wherein the steam causes the dye to penetrate into the fibers of the yarns and to be set.

FEED TO THE TUFTING MACHINE

After drying, the yarns are fed into a horizontal yarn guide plate 116 secured at the exit end of the drying chamber 115. The guide plate 116 has holes arranged in it, like the entrance yarn guide plate 9, for each individual yarn end. Attached to the plate 116 over each hole is a yarn guide tube 118 made of transparent synthetic plastic material or any other suitable tubular material. In the previously mentioned typical example there were 192 holes and 192 guide tubes. The whole group or set of yarn guide tubes is led conveniently overhead to a conventional tufting machine, designated generally by numeral 120. The tubes 118 are secured at their exit end to a yarn guide plate 122 like plate 116 supported from and transversely across the tufting machine.

The tufting machine may be a kind that produces pile of uniform height; or it may be of the kind that produces high or low loop pile or a combination thereof (as, for example, by said U.S. Pat. No. 2,954,865) or it may produce cut or loop pile or a combination thereof (as, for example, by Bryant et al. U.S. Pat. No. 3,187,699). One yarn end is fed through each guide tube. The tubes 118 must be of equal length, so that the yarns exiting therefrom will be in the same relationship laterally in the sheet as they were on entering the tubes and as maintained throughout the processing, from the time the dye was applied thereto. If there is a difference in lateral relationship of the yarns at the tufting needles from the predetermined relationship when leaving the dye rolls, the colors will appear off-set in the carpet and not in conformity with the desired pattern.

As the yarn ends exit from the guide tubes 118, they pass between one or more pairs of power driven feed rolls 124, 126, of the tufting machine. Two pairs of feed rolls are preferred, in order to avoid slippage and mis-register of the yarns at the feed stage and to provide more positive feed of the yarn ends. The feed rolls 124, 126 are synchronized with the draw roll 12, which, it will be recalled, controls the feed of the sheet of yarns to the dye-pick-up rolls, and are geared so that the peripheral speeds of the draw roll 12 and the machine feed rolls 124, 126 are the same, whether or not the diameters of the draw roll 12 and the feed rolls 124, 126 are the same.

SYNCHRONIZATION OF YARN FEEDS

Synchronization of the tufting machine yarn feed rolls 124, 126 with draw roll 12, and squeeze rolls 20, 22 of the dyeing machine is accomplished by chain and gear drive connections as follows:

Referring to FIG. 5, mounted on one extended end of shaft 25 of squeeze roll 22 is a gear 15. A similar gear 14 is mounted on an extended end of shaft 12*s* of the draw roll 12. Trained around gears 14 and 15 is a chain 16 causing the shafts 12*s* and 25 to rotate in unison, and together with them the draw and squeeze rolls 12 and 22, respectively, which are of the same diameter and therefore rotate with the same peripheral speed.

Also on squeeze roll-shaft 25 is another gear 18 around which is trained a chain 19 which is guided around idler gears (not shown) and in tracks (not shown) to the end of the dyeing machine and onward to gears (not shown) on the shafts of tufting machine rolls 124, 126 (see FIG. 2). This gearing causes the tufting machine rolls 124, 126 to rotate at the same peripheral speed as the draw and squeeze rolls, and also maintains the rotation of all said gears and rolls in synchronism.

SYNCHRONIZATION OF CESSATION OF YARN DYEING WITH CESSATION OF TUFTING MACHINE MOVEMENT

The tufting machine is driven by an electric motor M-1 under control of a conventional electromagnetic motor control switch EMS as diagrammatically shown in FIG. 8.

From the main shaft of the tufting machine, through a conventional adjustable reduction gear box and V-pulleys and V-belt (not shown), the yarn feed rolls 124, 126 are driven; and likewise the draw roll 12 and squeeze roll 22 are driven synchronously therewith as above described.

The drums of the pattern control mechanism are driven by a chain and gear connection 26, 27, 28 from a gear 26 on the squeeze roll shaft 25 and gear 28 on the pattern drum shaft by chain 27 (see FIGS. 3 and 9). The ratio of this gearing is determined for rotation of the pattern drum with a linear speed which will cause production of the dye pattern on the yarns of the yarn sheet in a predetermined length so that ultimately, when the yarn is tufted into a carpet in the tufting machine, the desired pattern will appear in the carpet.

Thus one motor, M-1, drives the tufting machine and its yarn feed rolls 124, 126 and squeeze roll 22, draw roll 12 and the pattern drums.

The dye pick-up rolls are driven by a variable speed motor M-2 through gear and chain connections or by any other connection. These dye pick-up rolls rotate continuously while the dye is in the receptacles 30, 50, 70, 90 which helps to keep the dye mixed. Each roll may be driven separately if so desired.

When the power to the tufting machine motor is turned off by pressing push button switch PB-2, the tufting machine, due to inertia of its motor and parts, does not stop instantaneously but continues for a few cycles of reciprocation. In contrast, when the electric power is cut off to the electrical elements of the pattern control system, specifically the pattern drums and solenoid valves, the solenoid valves close the air supply to the pneumatic cylinders 40. Thereupon, the piston rods 42, 62, 82, 102, being spring biased upwardly, immediately rise and the yarn sheet also rises out of contact with the dye-pick-up rolls. This prevents the yarns from picking up excess dye from the continuously rotating pick-up rolls.

In order to keep the pattern control operating while the tufting machine and the yarns are coming to a halt, a conventional time delay switch TDS, which is controlled by the electromagnetic motor control switch EMS, is placed in series circuit from the power line $L^2$ to the solenoid valves SV. The time delay of the opening of switch TDS is adjustable, but the closing is simultaneous with the closing of the contacts of the electromagnetic controller EMS.

Since the pattern drums are mechanically driven by gear and chain connections synchronously with the yarn feed rolls 124, 126 and draw roll 12 and squeeze roll 22, the drums will slow down and stop rotating as the rolls and yarn movement stop. The opening of the time delay switch will be adjusted to coincide with the dead-stop of the tufting machine, so that yarn rise from pick-up rolls will occur at that moment.

To start operations, push button switch PB-1 is closed. This closes the circuit to, and energizes, the coil of the electromagnetic control switch EMS, which closes its holding contacts *a* and *b* and the contacts *c* and *d* in the circuit to motor M-1, and auxiliary contacts *e* and *f* to the electric solenoid coil of time delay switch TDS. Thus, the tufting machine, the dyeing apparatus, and pattern control apparatus are simultaneously activated electrically and mechanically, with the pattern controls and yarn moving rods 42, 62, 82, 102, in the same condition as when they stopped.

The switches shown diagrammatically in FIG. 8 may be purchased on the market and are of known and common construction. Therefore, their structural details and circuitry need not be described herein.

Referring to the typical example, since 192 yarn ends pass through the dyeing machine, there will be 192 ends available to the tufting machine. And since 96 ends constitute each repeat (for convenience referred to as the "left" and "right" repeats) and since each pneumatically controlled piston rod controls a pair of yarn ends, two yarn ends will be dyed the same, e.g., the first yarn of the left repeat will be the same as the first yarn of the right repeat. Therefore, dyed yarns will be available to make two identical patterns across the carpet fabricated by the tufting machine. To accomplish this, the yarns issuing from the drying machine must be fed in a particular way to the tufting machine.

Assuming the yarn ends are numbered consecutively and the tufting machine needles are likewise numbered consecutively in the same direction, in the left repeat:

Yarn No. 1 will pass through tube No. 1 to needle No. 1;

Yarn No. 3 will pass through tube No. 3 to needle No. 2;

Yarn No. 5 will pass through tube No. 5 to needle No. 3;

Yarn No. 7 will pass through tube No. 7 to needle No. 4, and so on, until the end of the left repeat, where:

Yarn No. 185 will pass through tube No. 185 to needle No. 93;

Yarn No. 187 will pass through tube No. 187 to needle No. 94;

Yarn No. 189 will pass through tube No. 189 to needle No. 95.

Yarn No. 191 will pass through tube No. 191 to needle No. 96.

In the right repeat:

Yarn No. 2 will pass through tube No. 2 to needle No. 97;

Yarn No. 4 will pass through tube No. 4 to needle No. 98;

Yarn No. 6 will pass through tube No. 6 to needle No. 99;

Yarn No. 8 will pass through tube No. 8 to needle No. 100, and so on, until the end of the right repeat, where:

Yarn No. 186 will pass through tube No. 186 to needle No. 189;

Yarn No. 188 will pass through tube No. 188 to needle No. 190;

Yarn No. 190 will pass through tube No. 190 to needle No. 191;

Yarn No. 192 will pass through tube No. 192 to needle No. 192.

In other words, one yarn from each pneumatic control from left to right consecutively (1 through 96 pneumatic controls) will go to needles 1 through 96 consecutively forming the left 18 inches width repeat.

Also, one yarn from each pneumatic control from left to right consecutively (1 through 96 pneumatic controls) will go to needles 97 through 192 consecutively forming the right 18 inches width repeat.

The pattern repeat width may be altered by adding more yarn ends, manipulating assemblies, and pattern pick-up fingers (in the case of the continued use of the pattern drums).

Thus, each repeat at the entrance end provides two identical patterns side-by-side in the carpet; and a method is provided whereby the dyeing of a plurality of yarn ends simultaneously enables the production of an equal number of identical patterns side-by-side in a carpet.

Obviously, the number of ends under control of each individual piston rod will determine the number of patterns that can be duplicated across the carpet, practical considerations imposing the only limitation on the number.

The product produced by the tufting machine is an intermediate product. If the dye setting has been deferred, the intermediate product may be treated when convenient, conventionally in a steam chamber or otherwise to set the dye, and then may be finished in conventional fashion by application of adhesive and a heavy backing sheet.

Or, in the case of the previously mentioned alternative of setting the dye immediately after dyeing, the tufted product resulting from the tufting operation may be finished when convenient, by application of adhesive and a strong backing sheet as usual.

Modifications within the scope of the invention will occur to those skilled in the art. Therefore, the invention is not limited to the details of the apparatus and method as illustrated and described.

We claim:

1. Apparatus for dyeing yarn ends individually at predetermined positions along their lengths and manufacturing tufted carpets therefrom to produce a predetermined multi-colored complex pattern therein, the dyeing apparatus comprising a series of troughs containing different dye baths, a draw roll around which a sheet of yarn ends from a supply is trained and fed to said dye baths, a rotating pick-up roller supported above each trough and partially immersed in its dye bath, a plurality of banks of movable yarn guides for individual yarn ends, said banks extending laterally in planes parallel to the axes of said pick-up rollers and supported above said pick-up rollers, there being at least one bank of yarn guides for each pick-up roller, pattern control means to move each yarn guide individually to cause yarn carried by it to engage a pick-up roller while a predetermined length of yarn passes, a drying chamber through which the sheet of yarns passes subsequent to the last dye bath, a tufting machine having needles in which the individual yarn ends are threaded, and by which the yarn ends are needled through a backing sheet to reproduce the desired pattern, said tufting machine having at least one pair of cooperating feed rolls, and means to drive said tufting machine feed rolls and said draw roll in synchronism.

2. Apparatus as claimed in claim 1 in which said pattern control means includes electrical means to actuate said yarn guides, and electromotive driving means for said tufting machine, switching means controlling the electromotive means of said tufting machine, switching means controlling the electrical actuating means of said pattern control means, and time delay means causing a timed delay in shutting off power to said electrical actuating means when power to said tufting machine is shut off.

3. Apparatus as claimed in claim 1 in which the means to drive said rolls in synchronism comprises gears and chain means connecting said rolls.

4. Apparatus as claimed in claim 2 in which the means to drive said rolls in synchronism comprises gears and chain means connecting said rolls.

5. Apparatus as claimed in claim 1 having means extending horizontally and transversely between each pair of adjacent dye-pick-up rollers below a plane defined by the tops of said rolls to support sagging or broken yarn ends.

6. Apparatus as claimed in claim 1 in which each guide guides and controls a plurality of adjacent individual yarn ends, and each guide causes the yarn ends controlled by it to be dyed identically, and means to lead said identically dyed yarn ends to spaced groups of needles in identical relationships to cause identical patterns to be produced side-by-side in the carpet.

7. Apparatus as claimed in claim 1 having means to pretreat the yarn sheet before dyeing comprising a trough containing a bath with wetting and cleansing materials therein; and squeeze rolls between which said sheet is led to squeeze the yarn to remove excess bath liquid therefrom.

8. Apparatus as claimed in claim 7 in which said pattern control means includes electrical means to actuate said yarn guides, and electromotive driving means for said tufting machine, switching means controlling the electromotive means of said tufting machine, switching means controlling the electrical actuating means of said pattern control means, and time delay means causing a timed delay in shutting off power to said electrical actuating means when power to said tufting machine is shut off.

9. Apparatus as claimed in claim 8 in which the means to drive said rolls in synchronism comprises gears and chain means connecting said rolls.

10. Apparatus as claimed in claim 7 in which the means to drive said rolls in synchronism comprises gears and chain means connecting said rolls.

11. Apparatus as claimed in claim 1 having means to support each pick-up roll and its trough as a unit, each unit being movable individually from its operative position in the apparatus for servicing without disturbing the yarns.

12. Apparatus as claimed in claim 1 having supporting means resting on the floor to support each pick-up roll and its trough as a unit, each unit being movable individually from its operative position in the apparatus in a sidewise direction, without disturbing the yarn ends.

13. Apparatus as claimed in claim 11 having means supporting the pick-up roll at the ends of the trough, a shaft supporting said roll and extending beyond the trough at one end, and a drive gear mounted on said extending end.

14. Apparatus as claimed in claim 1 having a discharge opening in the bottom of the trough at one end, and a stand pipe over said opening and preventing outflow of dye while said stand pipe is in place, except over the top of the stand pipe, thereby controlling the dye level in the trough.

15. Apparatus as claimed in claim 7 in which each guide guides and controls a plurality of adjacent individual yarn ends, and each guide causes the yarn ends controlled by it to be dyed identically, and means to lead said identically dyed yarn ends to spaced groups of needles in identical relationships to cause identical patterns to be produced side-by-side in the carpet.

16. Apparatus as claimed in claim 1 having electrical means to actuate said yarn guides and in which said pattern control means includes a rotary drum with pattern means on its periphery which controls said electrical actuating means, and means to rotate said drum in synchronism with said draw and said feed rolls.

17. Apparatus as claimed in claim 2 in which said pattern control means includes a rotary drum with pattern means on its periphery which controls said electrical actuating means, and means to rotate said drum in synchronism with said draw and said feed rolls.

18. Apparatus as claimed in claim 7 in which said pattern control means includes a rotary drum with pattern means on its periphery which controls said electrical actuating means, and means to rotate said drum in synchronism with said draw and said feed rolls.

19. Apparatus as claimed in claim 8 in which said pattern control means includes a rotary drum with a pattern on its periphery which controls said electrical actuating means, and means to rotate said drum in synchronism with said draw, squeeze and feed rolls.

20. Apparatus as claimed in claim 17 in which the means to drive said rolls in synchronism comprises gears and chains connecting said rolls.

21. Apparatus as claimed in claim 16 in which the means to drive said rolls in synchronism comprises gears and chain means connecting said rolls.

22. Apparatus as claimed in claim 18 in which the means to drive said rolls in synchronism comprises gears and chain means connecting said rolls.

23. Apparatus as claimed in claim 19 in which the means to drive said rolls in synchronism comprises gears and chains connecting said rolls.

24. Apparatus as claimed in claim 1 in which said pattern control means comprises a bank of electro-responsive devices for each of said yarn guide banks for selectively operating the yarn guides of that bank, and electrical means to control the activation of said electro-responsive devices, and means maintaining the operations of said electro-responsive devices of said banks in synchronism with each other and in synchronism with said draw roll and said tufting machine feed rolls.

25. Apparatus as claimed in claim 24 in which the electrical means to control the activation of said electro-responsive devices includes rotary drums having pattern means thereon which controls electro-responsive devices.

26. Apparatus as claimed in claim 25 in which said synchronizing means comprises gear and chain means connecting said rolls.

27. The method for dyeing, individually, yarn ends of a sheet of yarn ends at predetermined positions along their lengths and producing a tufted carpet with a multi-colored predetermined complex design incorporated therein comprising feeding a sheet of yarns at a predetermined rate of linear speed to a series of dye baths, guiding a plurality of adjacent yarn ends as individual units side by side to a plurality of dye pick-up rolls, engaging predetermined lengths of selected units with different dye pick-up rolls having different dyes on their surfaces to apply different dyes to the yarn ends of individual units at different places along their lengths in different linear amounts, drying said sheet of yarns, and immediately and directly delivering one yarn end of each of successive adjacent units to successively numbered needles of a group of needles in a needle bank in a tufting machine, and likewise delivering the other yarn ends of each of said successive adjacent units to successively numbered needles of other groups of needles in said needle bank, with the dyed segments of the yarns in the same lateral relationship as when they left the last dye pick-up roll, maintaining the same linear speed of the yarn sheet at the time of delivery to the tufting machine as at the feeding of the sheet to the dye baths, and needling said yarns in said machine into a backing sheet to form an intermediate carpet product having the said predetermined design incorporated therein in adjacent repeats.

28. The method as claimed in claim 27 wherein said units each include a plurality of yarn ends, and wherein said delivery of the yarn ends to tufting machine needles comprises delivering one dried yarn end of the plurality forming one group in arithmetical order to one group of needles and the other yarn ends of said individual units individually in arithmetical order to other groups of needles in the tufting machine, with the dyed segments of the yarns in the same lateral relationship as when they left the last dye pick-up roll.

29. The method as claimed in claim 27 including the steps of feeding the sheet of yarns to a bath containing wetting and cleansing materials, passing said sheet through said bath and withdrawing said sheet from said bath, and squeezing said sheet to remove a predetermined amount of the bath liquid therefrom before subjecting the sheet to dyeing.

30. The method as claimed in claim 28 including the steps of feeding the sheet of yarns to a bath containing wetting and cleansing materials, passing said sheet through said bath and withdrawing said sheet from said bath, and squeezing said sheet to remove a predetermined amount of the bath liquid therefrom before subjecting the sheet to dyeing.

31. The method as claimed in claim 27 in which the drying step follows directly after the dyeing step, and dye fixation is deferred to a time subsequent to completion of the product produced by the tufting machine.

32. The method as claimed in claim 27 including yarns of the sheet between said dyeing and said drying steps.

33. The method as claimed in claim 29 in which the drying step follows directly after the dyeing step, and dye fixation is deferred to a time subsequent to completion of the product produced by the tufting machine.

34. The method as claimed in claim 29 including the step of fixing the dye in the yarns of the sheet between said dyeing and said drying steps.

* * * * *

UNITED STATES PATENT AND TRADEMARK OFFICE

CERTIFICATE OF CORRECTION

PATENT NO. : 4,015,550

DATED : April 5, 1977

INVENTOR(S) : William Chelsea Bartenfeld et al.

It is certified that error appears in the above-identified patent and that said Letters Patent are hereby corrected as shown below:

Column 14, line 14 (Claim 32) before "yarns" insert

-- the step of fixing the dye in the --.

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*